US008531094B2

(12) United States Patent
Suzuki et al.

(10) Patent No.: US 8,531,094 B2
(45) Date of Patent: Sep. 10, 2013

(54) SPARK PLUG HAVING SELF-CLEANING OF CARBON DEPOSITS

(75) Inventors: Akira Suzuki, Nagoya (JP); Tomoaki Kato, Nagoya (JP); Mamoru Musasa, Nagoya (JP); Jiro Kyuno, Kiyosu (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 225 days.

(21) Appl. No.: 12/595,732

(22) PCT Filed: Sep. 10, 2008

(86) PCT No.: PCT/JP2008/066307

§ 371 (c)(1),
(2), (4) Date: Oct. 13, 2009

(87) PCT Pub. No.: WO2009/034989

PCT Pub. Date: Mar. 19, 2009

(65) Prior Publication Data

US 2010/0117507 A1 May 13, 2010

(30) Foreign Application Priority Data

Sep. 13, 2007 (JP) ..... 2007-237383
Aug. 12, 2008 (JP) ..... 2008-207820

(51) Int. Cl.
*H01T 13/20* (2006.01)
*H01T 13/14* (2006.01)

(52) U.S. Cl.
USPC ..... 313/143; 123/169 CL

(58) Field of Classification Search
USPC ..... 313/141, 142, 143; 123/169 CL
See application file for complete search history.

(56) References Cited

U.S. PATENT DOCUMENTS 3,612,931 A * 10/1971 Strumbos ..... 313/11.5
4,664,986 A 5/1987 Draper et al.
(Continued)

FOREIGN PATENT DOCUMENTS

JP 60-165080 8/1985
JP 60-235379 11/1985
(Continued)

OTHER PUBLICATIONS

Machine Translation of Yamaguchi et al., JP 61-061390 A.*
(Continued)

*Primary Examiner* — Nimeshkumar Patel
*Assistant Examiner* — Steven Horikoshi
(74) *Attorney, Agent, or Firm* — Stites & Harbison PLLC; Jeffrey A. Haeberlin; Nicolo B. Davidson

(57) ABSTRACT

The present invention provides a spark plug that includes a center electrode extending in an axial direction, a ceramic insulator having an axial hole formed in the axial direction to retain the center electrode in a front side of the axial hole and thereby form an assembly unit of the center electrode and the ceramic insulator, a metal shell surrounding an outer circumference of the ceramic insulator to retain therein the assembly unit, and a ground electrode having one end portion joined to a front end face of the metal shell and the other end portion facing the center electrode to define a spark gap therebetween, wherein the spark plug satisfies the following conditions: $H \geqq 1$ mm, $Vc \leqq 17$ mm$^3$ and $Ra \geqq 1.0 \times 10^3$ K/(m·W) where H is a length by which the ceramic insulator protrudes toward the front from the front end face of the metal shell in the axial direction; Vc is a volume of part of the ceramic insulator extending within a range of 2 mm from a front end of the ceramic insulator toward the rear in the axial direction; and Ra is a thermal resistance per unit length, excluding air space, at 20° C. at a cross section of the assembly unit taken perpendicular to the axial direction at a position 2 mm away from the front end of the ceramic insulator.

17 Claims, 3 Drawing Sheets

(56) References Cited

U.S. PATENT DOCUMENTS

| | | | | |
|---|---|---|---|---|
| 5,514,929 | A * | 5/1996 | Kawamura | 313/141 |
| 6,208,066 | B1 * | 3/2001 | Kokubu et al. | 313/141 |
| 6,566,793 | B2 * | 5/2003 | Honda et al. | 313/141 |
| 6,724,133 | B2 * | 4/2004 | Miyashita et al. | 313/143 |
| 7,122,984 | B2 | 10/2006 | Koch et al. | |
| 7,183,702 | B2 | 2/2007 | Kanao et al. | |
| 7,408,294 | B2 | 8/2008 | Okabe et al. | |
| 2005/0168121 | A1 * | 8/2005 | Tinwell | 313/141 |

FOREIGN PATENT DOCUMENTS

| | | |
|---|---|---|
| JP | 61-61390 | 3/1986 |
| JP | 3-43982 | 2/1991 |
| JP | 3-149790 | 6/1991 |
| JP | 11-185928 | 7/1999 |
| JP | 2000-243535 | 9/2000 |

OTHER PUBLICATIONS

Engineering Toolbox, Thermal conductivity of some Common materials and Gases.*

JIS "Adaptability Test Code of Spark Plug for Automobiles" JIS D 1606, 1987.

JIS "Spark Plugs for Internal Combustion Engines" JIS B 8031, 1995.

National Astronomical Observatory of Japan.

National Astronomical Observatory of Japan, pp. 485-486, Nov. 30, 1996.

NGK, "Tech Support—Spark Plugs Overview 3," Internet, Sep. 7, 2007, retrieved at URL:http://web.archive.org/web/20070907005621/http://www.ngksparkplugs.com/tech_support/spark_plugs/p3.asp?mode=nml.

NGK, "Tech Support—Spark Plugs Overview 4," Internet, Sep. 8, 2007, retrieved at URL:http://web.archive.org/web/20070908041723/http://www.ngksparkplugs.com/tech_support/spark_plugs/p4.asp?mode=nml.

NGK, "Tech Support—Spark Plugs Overview 5," Internet, Sep. 7, 2007, retrieved at URL:http://web.archive.org/web/20070907180019/http://www.ngksparkplugs.com/tech_support/spark_plugs/p5.asp?mode=nml.

NGK, "Tech Support—Spark Plugs Overview 1," Internet, Sep. 2, 2007, retrieved at URL:http://web.archive.org/web/20070902084443/http://www.ngksparkplugs.com/tech_support/spark_plugs/p1.asp?mode=nml.

NGK, "Tech Support—Spark Plugs Overview 2," Internet, Sep. 7, 2007, retrieved at URL:http://web.archive.org/web/20070907230806/http://www.ngksparkplugs.com/tech_support/spark_plugs/p2.asp?mode=nml.

EPO, Extended European Search Report issued in corresponding EP Application No. 08831218.6, mailed Mar. 20, 2013.

* cited by examiner

SPARK PLUG HAVING SELF-CLEANING OF CARBON DEPOSITS

TECHNICAL FIELD

The present invention relates to a spark plug mounted on an internal combustion engine for ignition of an air-fuel mixture.

BACKGROUND ART

Conventionally, an internal combustion engine is provided with a spark plug for ignition of an air-fuel mixture. The spark plug generally includes a center electrode, a ceramic insulator formed with an axial hole to retain the center electrode, a mount fitting (as a metal shell) surrounding a radial circumference of the ceramic insulator to retain the ceramic insulator and a ground electrode having one end portion fixed to the mount fitting and the other end portion facing the center electrode so as to define therebetween a spark gap in which a spark discharge occurs to ignite the air-fuel mixture.

It has recently been required to provide an engine intake valve or exhaust valve with a larger valve diameter for improvement in engine output performance and to secure a greater water jacket for improvement in engine cooling system. These requirements result in a smaller installation space of the spark plug in the engine so that the spark plug needs to be reduced in diameter. However, the insulation distance between the ceramic insulator and the mount fitting decreases with the diameter of the spark plug. It is thus likely that the spark plug will cause a so-called lateral spark, which flies from the center electrode to the mount fitting through the ceramic insulator, rather than a proper spark discharge within the spark gap. Further, it is likely that the spark plug will cause a so-called recess spark under a smoldering state as the insulation between the ceramic insulator and the mount fitting gets lowered due to the depositing of conductive carbon on a surface of the ceramic insulator. In such a case, it is necessary to raise a front end temperature of the ceramic insulator and burn off the carbon deposits from the ceramic insulator in order to secure the insulation between the ceramic insulator and the mount fitting as occasion demands.

In view of the foregoing, Patent Publication 1 proposes one type of spark plug that satisfies the following conditions: $(X+0.3Y+Z)/G \geqq 2$, $Y1\ (mm) \geqq 1$, $W/Z \geqq 4$ and $1.25 \leqq Z\ (mm) \leqq 1.55$ where X is a distance from a front end portion of the ceramic insulator to the center electrode; Y is a creepage distance of a surface area of the ceramic insulator outside of the mount fitting; Y1 is an amount of protrusion of the ceramic insulator from the mount fitting; Z is an air pocket size; G is a spark gap size; and W is a length of a surface area of the ceramic insulator extending from a position corresponding to a front end face of the mount fitting to a position at which a distance between the ceramic insulator and the mount fitting is equal to the spark gap size G inside the mount fitting. By the above control of the respective component dimensions, the spark plug achieves a high ability to generate a spark discharge properly and stably within the spark gap under a non-smoldering state and to secure ignition performance even in the occurrence of a creeping discharge such as a lateral spark or a recess spark under a smoldering state. Patent Publication 1: Japanese Laid-Open Patent Publication No. 2005-116513

If the spark plug of Patent Publication 1 is applied to e.g. direct-injection engine in which smoldering is likely to occur, there is a problem of insufficient removal of the carbon deposits from the ceramic insulator whereby the spark plug cannot return to a state that provides adequate ignition performance.

It is thus desired to develop a technique for burning off the carbon deposits from the ceramic insulator quickly in order to return the spark plug from a smoldering state to a normal operating state and thereby secure ignition performance.

DISCLOSURE OF THE INVENTION

The present invention has been made to solve the above problems. It is an object of the present invention to provide a spark plug capable of allowing a ceramic insulator to rise in temperature rapidly so as to quickly burn off carbon deposits from the ceramic insulator.

According to an aspect of the present invention, there is provided a spark plug, comprising: a center electrode extending in an axial direction; a ceramic insulator having an axial hole formed in the axial direction to retain the center electrode in a front side of the axial hole and thereby form an assembly unit of the center electrode and the ceramic insulator; a metal shell surrounding an outer circumference of the ceramic insulator to retain therein the assembly unit; and a ground electrode having one end portion joined to a front end face of the metal shell and the other end portion facing the center electrode to define a spark gap therebetween, wherein the spark plug satisfies the following conditions: $H \geqq 1$ mm, $Vc \leqq 17$ $mm^3$ and $Ra \geqq 1.0 \times 10^3$ K/(m·W) where H is a length by which the ceramic insulator protrudes toward the front from the front end face of the metal shell in the axial direction; Vc is a volume of part of the ceramic insulator extending within a range of 2 mm from a front end of the ceramic insulator toward the rear in the axial direction; and Ra is a thermal resistance per unit length, excluding air space, at 20° C. at a cross section of the assembly unit taken perpendicular to the axial direction at a position 2 mm away from the front end of the ceramic insulator.

BEST MODE FOR CARRYING OUT THE INVENTION

Figure 1:
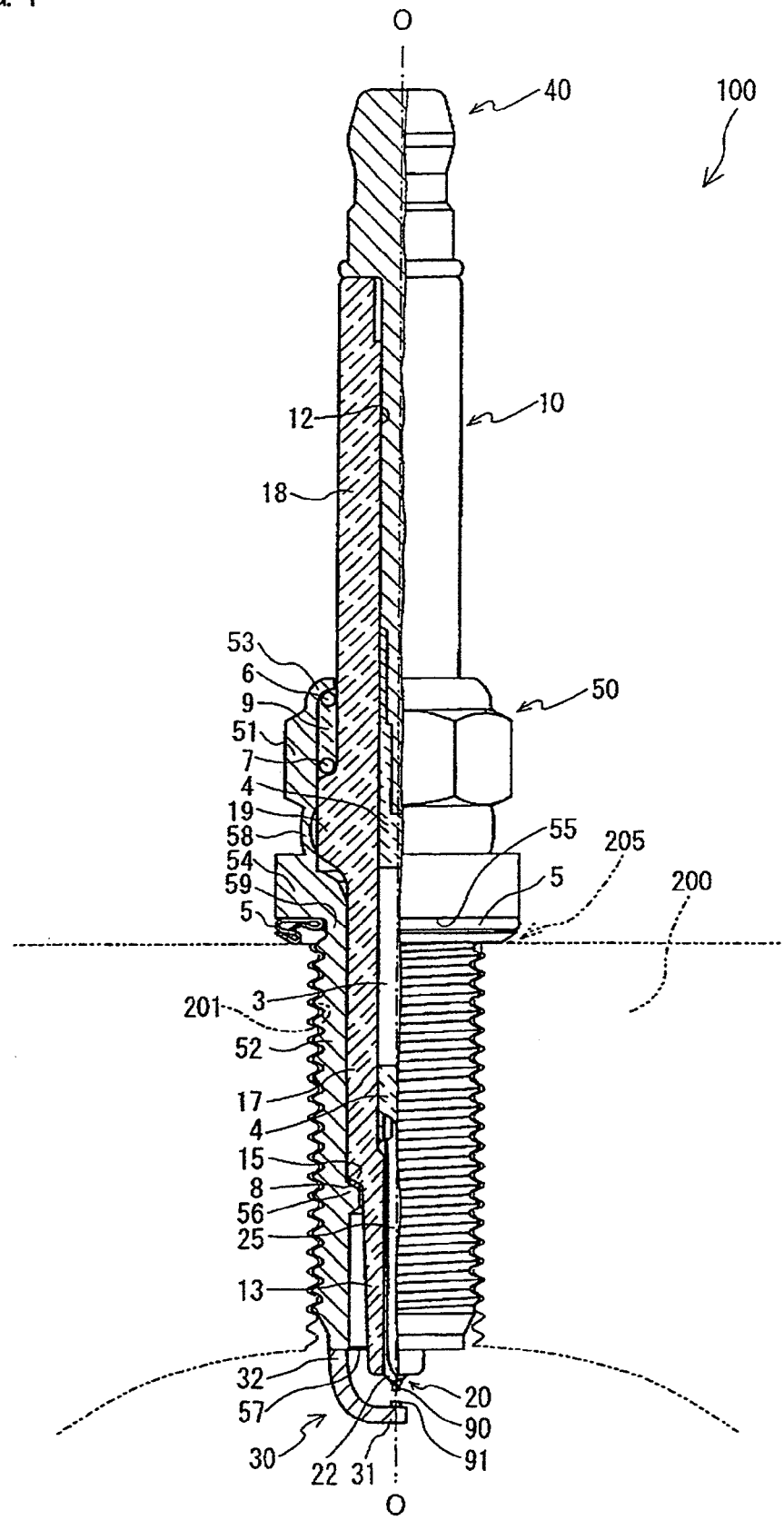
FIG. 1 is a partial section view of a spark plug according to one embodiment of the present invention.

Hereinafter, a spark plug 100 for an internal combustion engine according to one embodiment of the present invention will be described in detail below with reference to the drawings. In the following description, the terms "front" and "rear" refers to bottom and top sides of the drawing, respectively, when the direction of an axis O of the spark plug 100 is aligned with the top-to-bottom direction of the drawing. Further, the term "main component" refers to a component having the largest content (mass %) among all the components of a material.

As shown in FIG. 1, the spark plug 100 includes an ceramic insulator 10, a metal shell 50 retaining therein the ceramic insulator 10, a center electrode 20 retained in the ceramic insulator 10 in the direction of the axis O, a ground electrode 30 having a rear end portion 32 fixed to a front end face 57 of the metal shell 50 and a front end portion 31 facing at one side thereof a front end portion 22 of the center electrode 20 and a terminal fitting 40 disposed in a rear end portion of the ceramic insulator 10.

The ceramic insulator 10 is made of sintered alumina as is generally known and has a cylindrical shape with an axial hole 12 formed in the direction of the axis O. The ceramic insulator 10 includes a flanged section 19 located at a substantially middle position in the direction of the axis O and having the largest outer diameter, a rear body section 18 located on a rear side (upper side in FIG. 1) of the flanged section 19, a front body section 17 located on a front side (lower side in FIG. 1) of the flanged section 19 and having a smaller outer diameter than that of the rear body section 18 and a leg section 13 located on a front side of the front body section 17 and having a smaller outer diameter than that of the front body section 17. The leg section 13 tapers down toward the front and, when the spark plug 100 is mounted on a cylinder head 200 of the internal combustion engine, gets exposed to a combustion chamber of the engine. The ceramic insulator 10 also includes a stepped section 15 between the leg section 13 and the front body section 17.

Figure 2:
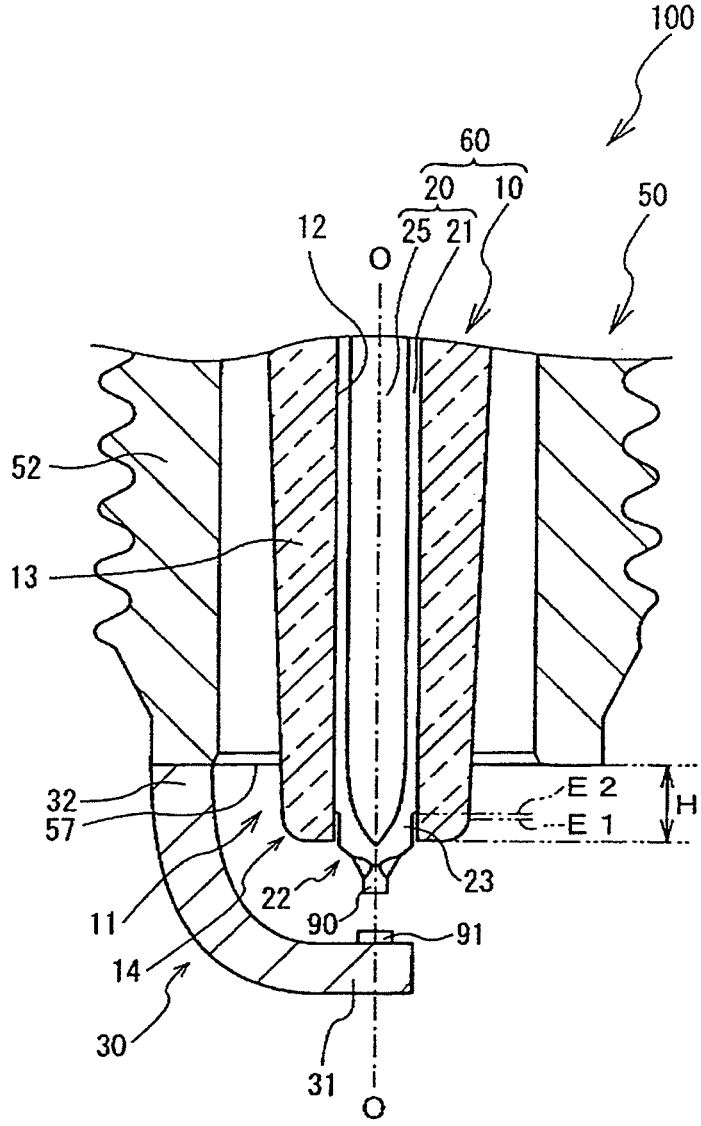
FIG. 2 is an enlarged view of a front end portion of a center electrode and its surroundings of the spark plug according to one embodiment of the present invention.

As shown in FIG. 2, a front end portion 11 of the ceramic insulator 10 (a front end part of the leg section 13) has a chamfered region 14 formed by chamfering an edge between the outer circumferential surface and front end face of the ceramic insulator 10 such that the chamfered region 14 decreases in outer diameter toward the front. The chamfered region 14 can be formed by chamfering with a radius of curvature of 0.3 mm to 0.7 mm (e.g. 0.5 mm). Further, the outer diameter of the front end portion 11 of the ceramic insulator 10 (the front end outer diameter of the ceramic insulator 10) can be set to 3.0 mm to 4.3 mm. It should be noted that the front end outer diameter of the ceramic insulator 10 refers to the outer diameter of the front end portion 11 of the ceramic insulator 10, excluding the outer diameter of the chamfered region 14, and preferably refers to the outer diameter of the ceramic insulator 10 at a position of a rear end of the chamfered region 14 (corresponding to a boundary position E1 between the chamfered region 14 and the outer circumferential surface of the ceramic insulator 10 in FIG. 2).

The center electrode 20 has a rod shape with an electrode body 21 made of nickel or alloy containing nickel as a main component, such as Inconel 600 or 601 (trade name), and a core 25 made of copper, which shows higher thermal conductivity than that of the electrode body, or alloy containing copper as a main component and embedded in the electrode body 21. In general, the center electrode 20 can be produced by forming the electrode body 21 into a bottomed cylindrical shape, inserting the core 25 in the electrode body 21 and extruding the resulting electrode material from the bottom side. The core 25 includes a body section of substantially constant outer diameter and a front end section of tapered shape. In the present embodiment, the outer diameter of the center electrode 20 is set to 2.3 mm; and the ratio of the outer diameter of the core 25 to the outer diameter of the center electrode 20 is set to 70%.

Figure 3:
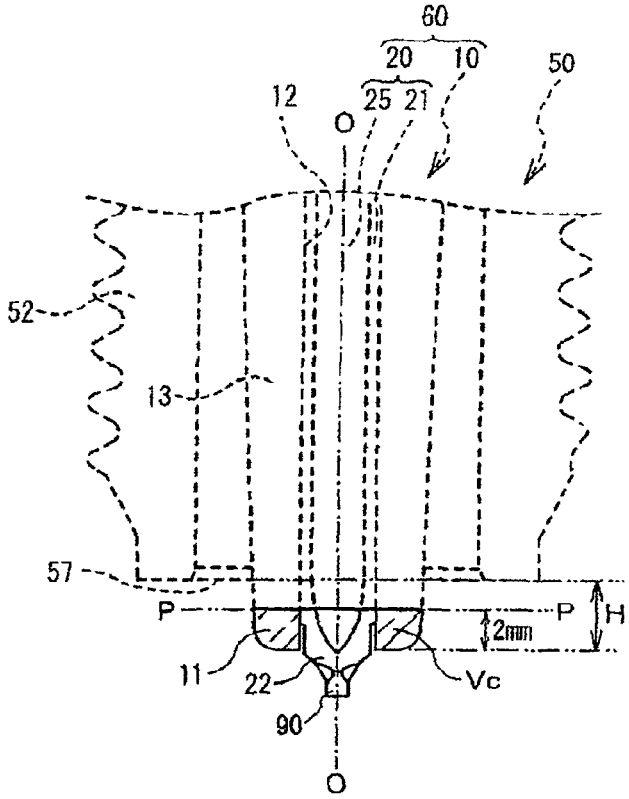
FIG. 3 is a schematic view showing the volume of a front end part of the ceramic insulator within a distance of 2 mm from the front end of the ceramic insulator in the direction of an axis of the spark plug.

The front end portion 22 of the center electrode 20 protrudes from the front end portion 11 of the ceramic insulator 10 and tapers down toward the front. The front end portion 22 of the center electrode 20 includes a reduced diameter region 23 that is reduced in outer diameter so as to leave a slight clearance between an outer circumferential surface of the reduced diameter region 23 and an inner circumferential surface of the axial hole 12 of the front end part of the ceramic insulator 10. The depth of the clearance in the direction of the axis O can be set to 0.8 mm to 2.0 mm (e.g. 1.0 mm). The center electrode 20 is inserted in the axial hole 12 toward the rear and is electrically connected to the terminal fitting 40 via a seal member 4 and a ceramic resistor 3. (See FIG. 1.) A high-voltage cable (not shown) is connected to the terminal fitting 40 via a plug cap (not shown) for the application of a high voltage to the terminal fitting 40. Herein, the unit in which the center electrode 20 is retained in the axial hole 12 of the ceramic insulator 10 is referred to as an assembly unit 60. (See FIGS. 2 and 3.)

An electrode tip 90 (as a first noble metal tip) of noble metal or noble metal alloy, which contains Pt or Ir as a main component and has a diameter of 1 mm or smaller (e.g. 0.6 mm), may be joined to a front end face of the front end portion 22 of the center electrode 20 for improvement in spark wear resistance. The joining is performed by laser welding the whole of the circumference of the mating faces between the electrode tip 90 and the front end portion 22 of the center electrode 20 in such a manner that the materials of the electrode tip 90 and the center electrode 20 are molten by laser irradiation and mixed to form a strong joint between the electrode tip 90 and the center electrode 20.

The ground electrode 30 is made of high corrosion resistant material as typified by nickel alloy such as Inconel 600 or 601 (trade name). As shown in FIG. 2, the ground electrode 30 is substantially rectangular in cross section in a longitudinal direction thereof and is bent to allow the rear end portion 32 to be welded to the front end face 57 of the metal shell 50 and allow one side of the front end portion 31 to face the front end portion 22 of the center electrode 20 and thereby define a spark gap between the front end portion 31 of the ground electrode 30 and the front end portion 22 of the center electrode 20.

An electrode tip 91 (as a second noble metal tip) of noble metal alloy, which contains Pt as a main component and at least one of Ph, Ir, Ni and Ru as an additional component, may also be joined to the one side of the front end portion 31 of the ground electrode 30 at such a position that the spark gap becomes defined between the electrode tips 90 and 91.

As shown in FIG. 1, the metal shell 50 is designed as a cylindrical fitting for mounting the spark plug 100 in the cylinder head 200 of the internal combustion engine while retaining therein the ceramic insulator 10 by surrounding a circumferential region of the ceramic insulator 10 from a part of the rear body section 18 through to the led portion 13. The metal shell 50 is made of low carbon steel material and includes a tool engagement portion 51 engageable with a spark plug wrench (not shown) and a mount thread portion 52 formed with a screw thread for screwing into a mount thread hole 201 of the cylinder head 200 at an upper portion of the internal combustion engine. The outer diameter of the mount thread portion 52 is preferably set to a nominal diameter size M10 or smaller according to JIS B8031 (1995).

The metal shell 50 also includes a flanged seal portion 54 between the tool engagement portion 51 and the mount thread portion 52. An annular gasket 5 is formed by bending a plate material and fitted on a thread neck 59 between the mount thread portion 52 and the seal portion 54. When the spark plug 100 is mounted on the engine head 200, the gasket 5 is compressed and deformed between a bearing surface 55 of the seal portion 54 and an opening edge area 205 of the mount thread hole 201 so as to establish a seal therebetween and prevent engine gas leakage through the mount thread hole 201.

The metal shell 50 further includes a swage portion 53 formed on a rear side of the tool engagement portion 51 and made small in thickness and a buckling portion 58 formed between the seal portion 54 and the tool engagement portion 51 and made small in thickness as in the case of the swage portion 53. Annular ring members 6 and 7 are interposed between an inner circumferential surface of a region of the metal shell 50 from the tool engagement portion 51 to the swage portion 53 and an outer circumferential surface of the rear body region 18 of the ceramic insulator 10. Further, a talc powder 9 is filled in between these ring members 6 and 7. The swage portion 53 is swaged inwardly to push the ceramic insulator 10 toward the front in the metal shell 50 via the ring members 6 and 7 and the talc powder 9 so as to retain the stepped section 15 of the ceramic insulator 10 on a stepped section 53 of the metal shell 50, which is formed on an inner circumferential surface of the metal shell 50 at a position corresponding to the mount thread portion 52, via an annular plate packing 8 and thereby integrate the metal shell 50 and the ceramic insulator 10. At this time, the gastightness between the metal shell 50 and the ceramic insulator 10 is maintained by the plate packing 8 to prevent combustion gas leakage. The buckling portion 58 is bent and deformed outwardly by the application of a compression force during swaging so as to secure the compression stroke of the talc 9 and increase the gastightness inside the metal shell 50.

When the above-structured spark plug 100 is in a smoldering state where carbon deposits occur on a front end surface of the ceramic insulator 10, the ceramic insulator 10 decreases in insulation resistance to cause a drop in ignition coil generation voltage. The spark plug 100 cannot generate a spark plug as the ignition coil generation voltage becomes lower than a required plug voltage (at which the spark discharge occurs in the spark gap). This results in misfiring. In order to prevent such misfiring, the spark plug 100 is configured to perform the function of raising a front end temperature of the ceramic insulator 10 to about 450° C. and thereby burning off the carbon deposits from the ceramic insulator 10. This function is called "self-cleaning".

By the quick self-cleaning, the spark plug can be returned promptly from the smoldering state to a state that provides normal ignition performance. It is necessary for the quick self-cleaning to raise the front end temperature of the ceramic insulator 10 rapidly. The protrusion amount, volume and thermal resistance of the front end part of the ceramic insulator 10 are thus controlled optimally, as demonstrated by Experiments 1, 2 and 3, in order to improve the temperature rise characteristics of the front end part of the ceramic insulator 10. These parameters will be explained below in detail with reference to FIGS. 2 and 3. The optimal values of the parameters will be verified later by Experiments 1, 2 and 3.

It is herein defined that: H (mm) is a protrusion amount (length) by which the ceramic insulator 10 protrudes toward the front from the front end face 57 of the metal shell 57 in the direction of the axis O. It is also defined that: assuming that the assembly unit 60 is cut along a plane P (indicated by a chain double-dashed line P-P) that passes through a position 2 mm away from the front end of the ceramic insulator 10 toward the rear in the direction of the axis O and extends perpendicular to the axis O, Vc ($mm^3$) is a volume of the front end part of the ceramic insulator 10 cut along the plane P; Ra (K/(m·W)) is a thermal resistance per unit length, excluding air space, at room temperature (20° C.) at the cross section of the assembly unit 60 taken along the plane P; and Rb (K/(m·W)) is a thermal resistance per unit length, excluding air space, at high temperature (800° C.) at the cross section of the assembly unit 60 taken along the plane P.

The thermal resistance is a numerical value indicating a degree of difficulty in heat transfer through a material. The larger the value of the thermal resistance, the more difficult the heat transfer through the material. The smaller the value of the thermal resistance means, the easier the heat transfer through the material. For the determination of the thermal resistance at the certain cross section of the assembly unit 60, it is defined that: Ki is a thermal conductivity of the ceramic insulator 10; Kn is a thermal conductivity of the electrode body 21 (nickel alloy) of the center electrode 20; Kc is a thermal conductivity of the core 25 (copper alloy) of the center electrode 20. It is further defined that: Si, Sn and Sc are a cross sectional area of the ceramic insulator 10, a cross sectional area of the electrode body 21 of the center electrode 20 and a cross sectional area of the core 25 of the center electrode 20, respectively, taken along the plane P; and Ri, Rn and Rc are a thermal resistance of the ceramic insulator 10, a thermal resistance of the electrode body 21 of the center electrode 20 and a thermal resistance of the core 25 of the center electrode 20, respectively, at the cross sections taken along the plane P. The thermal resistance R (K/(m·W)) per unit length at the cross section of the assembly unit 60 along the plane P can be derived from the following equation:

$$1/R=(1/Ri)+(1/Rn)+(1/Rc)=KiSi+KnSn+KcSc$$

$$R=1/(KiSi+KnSn+KcSc)$$

In the present embodiment, the protrusion amount H of the ceramic insulator 10, the front end volume Vc of the ceramic insulator 10 and the thermal resistance Ra at the cross section through the position 2 mm away from the front end of the ceramic insulator 10 are controlled to satisfy the following conditions: $H \geqq 1$ mm, $Vc \leqq 17$ $mm^3$ and $Ra \geqq 1.0\times10^3$ K/(m·W). This makes it possible to attain the optimal flow of heat through the ceramic insulator 10 for rapid temperature rise of the ceramic insulator 10.

If the protrusion amount H of the ceramic insulator 10 is less than 1 mm, it is difficult to raise the front end temperature of the ceramic insulator 10 so that all of the carbon deposits cannot be burned off. As the carbon deposits remain on the ceramic insulator 10, there readily occurs a lateral spark, which flies from the center electrode 20 to the metal shell 50 through the ceramic insulator 10, or a recess spark (discharge leak phenomenon). The spark plug 100 cannot thus achieve sufficient performance. When the protrusion amount H is larger than or equal to 1 mm, the spark plug 100 is able to raise the temperature of the ceramic insulator 10 more rapidly so that the carbon deposits can be quickly burned off from the ceramic insulator 10. It is accordingly possible to achieve a high effect of not only preventing the occurrence of a creeping discharge such as a lateral spark or a recess spark but also securing insulation resistance required for vehicle driving.

If the front end volume Vc of the ceramic insulator 10 exceeds 17 $mm^3$, it is difficult to raise the front end temperature of the ceramic insulator 10 so that all of the carbon deposits cannot be burned off. When the front end volume Vc of the ceramic insulator 10 is smaller than 17 $mm^3$, the spark plug 100 is able to raise the temperature of the ceramic insulator 10 more rapidly so that the carbon deposits can be quickly burned off from the ceramic insulator 10. It is accordingly possible to achieve a high effect of preventing the occurrence of a creeping discharge such as lateral spark or recess spark and securing insulation resistance required for vehicle driving.

It is particularly preferable to satisfy the following condition: $Vc \leqq 12$ $mm^3$ The temperature rise characteristics of the ceramic insulator 10 within the range of 2 mm from the front end can be further improved by decreasing the front end volume Vc to 12 $mm^3$ or smaller while maintaining the high thermal resistance Ra as above. Even if carbon deposits occur on the ceramic insulator 10, the spark plug 100 attains the ability to raise the temperature of the ceramic insulator 10 more rapidly, burn off the carbon deposits quickly from the ceramic insulator 10 and thereby return from such a fouling state promptly. It is thus possible to maintain the insulation resistance of the spark plug 100 at a high level of 100 MΩ or higher for good drivability (driving performance).

It is also particularly preferable to satisfy the following condition: $Vc \geqq 8\ mm^3$ If the front end volume Vc is less than 8 $mm^3$, the radial thickness (wall thickness) of the front end portion 11 of the ceramic insulator 10 is so small that there arises a possibility that an insulation failure occurs in the ceramic insulator 10. The ceramic insulator 10 can secure a sufficient wall thickness (radial thickness) within the range of 2 mm from the front end by controlling the front end volume Vc to 8 $mm^3$ or larger. This makes it unlikely that the insulation failure will occur in the ceramic insulator 10. It is thus possible to ensure the insulation resistance of the spark plug 100 for good drivability.

The spark plug 100 attains the ability to raise the front end temperature of the ceramic insulator 10 rapidly, burn off the carbon deposits from the ceramic insulator 10 and thereby maintain its insulation resistance at an engine startable level of 10 MΩ or higher when the thermal resistance Ra at the cross section through the position 2 mm away from the front end of the ceramic insulator 10 is higher than or equal to $1.0\times10^3$ K/(m·W) at the room temperature.

The thermal resistance Rb at the cross section through the position 2 mm away from the front end of the ceramic insulator 10 may be controlled to $1.0\times10^4$ K/(m·W) or lower, preferably $0.8\times10^4$ K/(m·W) or lower at the high temperature. If the thermal resistance Rb becomes higher than $1.0\times10^4$ K/(m·W) in a state that the temperature of the ceramic insulator 10 is sufficiently high to burn off the carbon deposits, the consumption of the electrode tip 90 on the center electrode 20 increases due to insufficient heat radiation and causes an abrupt decrease in the durability of the spark plug 100. When the thermal resistance Rb is lower than or quail to $1.0\times10^4$ K/(m·W), the spark plug 100 is able to maintain durability such as wear resistance by smooth heat radiation from the noble metal tip 90 on the front end portion 22 of the center electrode 20. The spark plug 100 is able to maintain good durability by more smooth heat radiation when the thermal resistance Rb is lower than or quail to $0.8\times10^4$ K/(m·W).

As explained above, the temperature rise characteristics of the front end part of the ceramic insulator 10 can be improved by controlling the respective parameters as follows: $H \geqq 1$ mm, $Vc \leqq 17\ mm^3$ and $Ra \geqq 1.0\times10^3$ K/(m·W). This makes it possible that the spark plug 100 can raise the front end temperature of the ceramic insulator 10 rapidly and burn off carbon deposits quickly from the surface of the front end part of the ceramic insulator 10. As the carbon deposits do not remain on the surface of the ceramic insulator 10, it is possible to prevent the occurrence of a creeping discharge such as a lateral spark or a recess spark and ensure the proper and stable ignition of an air-fuel mixture.

The spark plug is able to attain high durability and limit the consumption of the electrode tip 90 of the center electrode 20 by controlling the parameter to satisfy the condition: $Rb \leqq 1.0\times10^4$ K/(m·W) (preferably, $0.8\times10^4$ K/(m·W)).

In the case where the spark plug 100 is of small diameter type that the outer diameter of the mount thread portion 52 of the metal shell 50 is smaller than the equal to the nominal diameter size M10 according to JIS specification, the above effects are particularly advantageously exerted. As the spark plug 100 decreases in diameter, it becomes more difficult to secure the clearance between the metal shell 50 and the ceramic insulator 10 so that there readily occurs a lateral spark or a recess spark unless the carbon deposits are removed quickly from the ceramic insulator 10. Even in such a small-diameter spark plug 100 that the outer diameter of the screw thread of the mount thread portion 52 is smaller than the equal to the nominal diameter size M10, the ceramic insulator 10 with the improved temperature rise characteristics enables the self-cleaning so that the carbon deposits can be burned off from the ceramic insulator 10 quickly regardless of the narrow clearance between the inner circumferential surface of the metal shell 50 and the outer circumferential surface of the ceramic insulator 10. It is thus possible to prevent the occurrence of a creeping discharge, which flies from the center electrode 20 to the metal shell 50 through the ceramic insulator 10, and ensure the proper and stable ignition of an air-fuel mixture.

It is further possible to maintain the insulation resistance of the spark plug 100 at 100 MΩ or higher by satisfying the condition: $Vc \leqq 12\ mm^3$. On the other hand, it is possible to secure the radial thickness (wall thickness) of the front end portion 11 of the ceramic insulator 10 and makes it unlikely that the insulation failure will occur by satisfying the condition: $Vc \geqq 8\ mm^3$.

Further, the chamfered region 14 is formed on the front end portion 11 of the ceramic insulator 10 so as to decrease in outer diameter toward the front; and the reduced diameter region 23 is formed on the front end portion 22 of the center electrode 20 so as to become reduced in outer diameter. (See FIG. 2.) There is some clearance left between the outer circumferential surface of the reduced diameter region 23 of the center electrode 20 and the inner circumferential surface of the axial hole 12 of the front end part of the ceramic insulator 10. In such a configuration, the outer diameter of the center electrode 20 changes discontinuously at the rear end of the reduced diameter region 23 (i.e. at a position E2 in FIG. 2) whereby it is likely that an electric field will concentrate on or around the rear end of the reduced diameter region 23. If the wall thickness of the ceramic insulator 10 is small at a position corresponding to the rear end of the reduced diameter region, there is a possibility of insulation failure in the ceramic insulator 10. The rear end (position E2) of the reduced diameter region 23 is thus preferably located on a rear side of the rear end (position E1) of the chamfered region 14. The curvature radius of the chamfered region 14 and the depth of the clearance in the direction of the axis O are controlled to 0.3 to 0.7 mm and 0.8 to 2.0 mm, respectively. With this, the ceramic insulator 10 can secure the wall thickness at the position corresponding to the rear end (position E2) of the reduced diameter region 23 so as to prevent the occurrence of insulation failure in the ceramic insulator 10.

Furthermore, the electrode tip 90 on the center electrode 20 is made of noble metal or noble metal alloy having a diameter of 1 mm or smaller and containing Pt or Jr as a main component. In the spark plug 100 of the present embodiment in which the front end part of the ceramic insulator 10 attains the improved temperature rise characteristics, the center electrode 20 is subjected to high heat load as the self-clearing is preformed to raise the temperature of the ceramic insulator 10 rapidly in the fouling state. When the electrode tip 90 is made of noble metal or noble metal alloy with high melting point and high spark wear resistance and joined to the front end portion 22 of the center electrode 20 so that the spark discharge occurs through the electrode tip 90, the spark plug 100 can favorably secure spark wear resistance even under the high heat load and maintain high durability. The spark plug 100 can also favorably attain high resistance to electrode wear by the spark discharge when the electrode tip 91 is joined to the ground electrode 30 and made of noble metal alloy with high melting point and high spark wear resistance, more specifically, noble metal alloy containing Pt as a main component and at least one of Rh, Ir, Ni and Ru as an additional component.

The present invention will be described in more detail by reference to the following examples. It should be however noted that the following examples are only illustrative and not intended to limit the invention thereto.

Experiment 1

In Experiment 1, the influences of the protrusion amount H and front end volume Vc of the ceramic insulator 10 and the thermal resistance Ra on the insulation resistance of the spark plug 100 were tested.

There are two methods of adjusting the thermal resistance Ra. One method is to change the material and volume of the core of the center electrode. As the material of the core of the center electrode, there can be used nickel, nickel alloy or copper alloy. Another method is to change the material of the ceramic insulator. There can be used alumina or aluminum nitride as the material of the ceramic insulator. In this experiment, alumina and aluminum nitride each having a thermal conductivity of 15 to 170 W/(K·m) were used. The tests were conducted on the following two cases: Case 1 in which the thermal resistance Ra was adjusted by changing the material of the core of the center electrode: and Case 2 in which the thermal resistance Ra was adjusted by changing the material of the ceramic insulator. The influence of a difference between these two adjusting methods on the test results was examined.

In both of Cases 1 and 2, five different test groups were provided for the protrusion amount H of the ceramic insulator 10. More specifically, the test groups were set as follows in Case 1: Test group 1-1 (protrusion amount: H=0 mm); Test group 1-2 (protrusion amount: H=1 mm); Test group 1-3 (protrusion amount: H=1.8 mm); Test group 1-4 (protrusion amount: H=2.3 mm); and Test group 1-5 (protrusion amount: 3.8 mm). The test groups were set as follows in Case 2: Test group 2-1 (protrusion amount: H=0 mm); Test group 2-2 (protrusion amount: H=1 mm); Test group 2-3 (protrusion amount: H=1.8 mm); Test group 2-4 (protrusion amount: H=2.3 mm); and Test group 2-5 (protrusion amount: H=3.8 mm). Further, thirty-six combinations of six values of the front end volume Vc and six values of the thermal resistance Ra were provided in the respective test groups. More specifically, the following six values were set for the front end volume Vc: 8 $mm^3$, 12 $mm^3$, 14.5 $mm^3$, 17 $mm^3$, 19 $mm^3$ and 20 $mm^3$. The following six values were set for the thermal resistance Ra: 0.6, 0.8, 1.0, 2.0, 4.0 and 6.0 ($\times 10^3$ K/(m·W)) in Case 1; and 0.6, 0.7, 0.8, 1.0, 1.2 and 1.5 ($\times 10^3$ K/(m·W)) in Case 2.

Samples of the ceramic insulator were prepared in such a manner as to satisfy the set values of the protrusion amount H, the front end volume Vc and the thermal resistance Ra of the respective test groups. Samples of the spark plug were produced using these samples of the ceramic insulator, respectively. The outer diameter of the mount thread portion of the spark plug sample was controlled to a nominal diameter size M10 according to JIS B8031.

Each of the produced spark plug samples was subjected to smoldering/fouling test according to JIS D1606 and subjected to insulation resistance measurement (S2) according to JIS B8031. The insulation resistance of the spark plug sample at the completion of 10 test cycles was evaluated in 4 levels from A to D. In this experiment, the sample was evaluated as: "A" when the insulation resistance was 100 MΩ or higher at the completion of 10 test cycles; "B" when the resistance was higher than or equal to 10 MΩ and lower than 100 MΩ at the completion of 10 test cycles; "C" when the resistance was lower than 10 MΩ at the completion of 10 test cycles; and "D" when any engine start failure occurred during the test cycles. The temperature rise characteristics of the sample were considered as "good" when the insulation resistance was so high that the front end temperature of the ceramic insulator was raised rapidly to burn off the carbon deposits from the ceramic insulator quickly. By contrast, the temperature rise characteristics of the sample were considered as "poor" when the insulation resistance was so low that the front end temperature of the ceramic insulator was not raised rapidly to leave the carbon deposits on the ceramic insulator. The evaluation results are indicated in TABLES 1 to 10.

In the sample preparation using above adjusting methods of the thermal resistance Ra, the adjustable range of the thermal resistance Ra was limited depending on the relationship between the front end volume Vc of the ceramic insulator and the chemical properties of the materials of the center electrode and the ceramic insulator. The adjustable range of the thermal resistance Ra of Case 1 was different from that of Case 2 due to the difference in the adjusting methods of the thermal resistance Ra.

In Case 1, the thermal resistance Ra was adjusted to within the range of $0.6\times10^3$ to $6.0\times10^3$ K/(m·W). It was impossible to prepare samples of the ceramic insulator with a front end volume Vc of 12 $mm^3$ or larger and a thermal resistance Ra of $6.0\times10^3$ K/(m·W) and samples of the ceramic insulator with a front end volume Vc of 20 $mm^3$ and a thermal resistance Ra of $4.0\times10^3$ K/(m·W). As there were no data obtained for these parameter combinations, the symbol "-" is assigned to the corresponding data boxes in TABLES 1 to 5.

In Case 2, the thermal resistance Ra was adjusted to within the range of $0.6\times10^3$ to $1.5\times10^3$ K/(m·W), which was narrower than that in Case 1. It was impossible to prepare samples of the ceramic insulator with a front end volume Vc of 8 to 14.5 $mm^3$ and a thermal resistance Ra of $0.6\times10^3$ K/(m·W) and samples of the ceramic insulator with a front end volume Vc of 8 $mm^3$ and a thermal resistance Ra of $0.7\times10^3$ K/(m·W). As there were no data obtained for these parameter combinations, the symbol "-" is assigned to the corresponding data boxes in TABLES 6 to 10.

TABLE 1

| Test group 1-1 | | Ra ($\times10^3$ K/(m · W) | | | | | |
|---|---|---|---|---|---|---|---|
| H = 0 mm | | 0.6 | 0.8 | 1.0 | 2.0 | 4.0 | 6.0 |
| Vc ($mm^3$) | 20 | D | D | D | D | — | — |
| | 19 | D | D | D | D | D | — |
| | 17 | D | D | D | D | D | — |
| | 14.5 | D | D | D | D | D | — |
| | 12 | D | D | D | D | D | — |
| | 8 | D | D | D | D | D | D |

TABLE 2

| Test group 1-2 | | Ra ($\times10^3$ K/(m · W) | | | | | |
|---|---|---|---|---|---|---|---|
| H = 1 m | | 0.6 | 0.8 | 1.0 | 2.0 | 4.0 | 6.0 |
| Vc ($mm^3$) | 20 | D | D | D | D | — | — |
| | 19 | D | D | D | D | D | — |
| | 17 | D | D | B | B | B | — |
| | 14.5 | D | C | B | B | B | — |
| | 12 | D | C | A | A | A | — |
| | 8 | D | C | A | A | A | A |

TABLE 3

| Test group 1-3 | | Ra ($\times 10^3$ K/(m · W) | | | | | |
|---|---|---|---|---|---|---|---|
| H = 1.8 m | | 0.6 | 0.8 | 1.0 | 2.0 | 4.0 | 6.0 |
| Vc ($mm^3$) | 20 | D | D | D | D | — | — |
| | 19 | D | D | D | D | D | — |
| | 17 | D | C | B | B | B | — |
| | 14.5 | D | C | B | B | B | — |
| | 12 | D | C | A | A | A | — |
| | 8 | D | C | A | A | A | A |

TABLE 4

| Test group 1-4 | | Ra ($\times 10^3$ K/(m · W) | | | | | |
|---|---|---|---|---|---|---|---|
| H = 2.3 m | | 0.6 | 0.8 | 1.0 | 2.0 | 4.0 | 6.0 |
| Vc ($mm^3$) | 20 | D | D | D | D | — | — |
| | 19 | D | D | D | D | D | — |
| | 17 | D | C | B | B | B | — |
| | 14.5 | D | C | B | B | B | — |
| | 12 | D | C | A | A | A | — |
| | 8 | D | C | A | A | A | A |

TABLE 5

| Test group 1-5 | | Ra ($\times 10^3$ K/(m · W) | | | | | |
|---|---|---|---|---|---|---|---|
| H = 3.8 m | | 0.6 | 0.8 | 1.0 | 2.0 | 4.0 | 6.0 |
| Vc ($mm^3$) | 20 | D | D | D | D | — | — |
| | 19 | D | D | D | D | D | — |
| | 17 | D | C | B | B | B | — |
| | 14.5 | D | C | B | B | B | — |
| | 12 | D | C | A | A | A | — |
| | 8 | D | C | A | A | A | A |

TABLE 6

| Test group 2-1 | | Ra ($\times 10^3$ K/(m · W) | | | | | |
|---|---|---|---|---|---|---|---|
| H = 0 m | | 0.6 | 0.7 | 0.8 | 1.0 | 1.2 | 1.5 |
| Vc ($mm^3$) | 20 | D | D | D | D | D | D |
| | 19 | D | D | D | D | D | D |
| | 17 | D | D | D | D | D | D |
| | 14.5 | — | D | D | D | D | D |
| | 12 | — | D | D | D | D | D |
| | 8 | — | — | D | D | D | D |

TABLE 7

| Test group 2-2 | | Ra ($\times 10^3$ K/(m · W) | | | | | |
|---|---|---|---|---|---|---|---|
| H = 1 m | | 0.6 | 0.7 | 0.8 | 1.0 | 1.2 | 1.5 |
| Vc ($mm^3$) | 20 | D | D | D | D | D | D |
| | 19 | D | D | D | D | D | D |
| | 17 | D | D | D | B | B | B |
| | 14.5 | — | D | C | B | B | B |
| | 12 | — | D | C | A | A | A |
| | 8 | — | — | C | A | A | A |

TABLE 8

| Test group 2-3 | | Ra ($\times 10^3$ K/(m · W) | | | | | |
|---|---|---|---|---|---|---|---|
| H = 1.8 m | | 0.6 | 0.7 | 0.8 | 1.0 | 1.2 | 1.5 |
| Vc ($mm^3$) | 20 | D | D | D | D | D | D |
| | 19 | D | D | D | D | D | D |
| | 17 | D | D | C | B | B | B |
| | 14.5 | — | D | C | B | B | B |
| | 12 | — | D | C | A | A | A |
| | 8 | — | — | C | A | A | A |

TABLE 9

| Test group 2-4 | | Ra ($\times 10^3$ K/(m · W) | | | | | |
|---|---|---|---|---|---|---|---|
| H = 2.3 m | | 0.6 | 0.7 | 0.8 | 1.0 | 1.2 | 1.5 |
| Vc ($mm^3$) | 20 | D | D | D | D | D | D |
| | 19 | D | D | D | D | D | D |
| | 17 | D | D | C | B | B | B |
| | 14.5 | — | D | C | B | B | B |
| | 12 | — | D | C | A | A | A |
| | 8 | — | — | C | A | A | A |

TABLE 10

| Test group 2-5 | | Ra ($\times 10^3$ K/(m · W) | | | | | |
|---|---|---|---|---|---|---|---|
| H = 3.8 m | | 0.6 | 0.7 | 0.8 | 1.0 | 1.2 | 1.5 |
| Vc ($mm^3$) | 20 | D | D | D | D | D | D |
| | 19 | D | D | D | D | D | D |
| | 17 | D | D | C | B | B | B |
| | 14.5 | — | D | C | B | B | B |
| | 12 | — | D | C | A | A | A |
| | 8 | — | — | C | A | A | A |

As shown in TABLE 1, all of the samples of Test group 1-1 was evaluated as "D" regardless of the values of the front end volume Vc of the ceramic insulator and the thermal resistance Ra.

As shown in TABLE 2, the samples of Test group 1-2 having a front end volume Vc of 8 to 12 $mm^3$ and a thermal resistance Ra of $1.0\times10^3$ to $6.0\times10^3$ K/(m·W) were evaluated as "A". The samples of Test group 1-2 having a front end volume Vc of 14.5 to 17 $mm^3$ and a thermal resistance Ra of $1.0\times10^3$ to $4.0\times10^3$ K/(m·W) were evaluated as "B". The samples of Test group 1-2 having a front end volume Vc of 8 to 14.5 $mm^3$ and a thermal resistance Ra of $0.8\times10^3$ K/(m·W) were evaluated as "C". All other samples of Test group 1-2 were evaluated as "D".

As shown in TABLE 3, the samples of Test group 1-3 having a front end volume Vc of 8 to 12 $mm^3$ and a thermal resistance Ra of $1.0\times10^3$ to $6.0\times10^3$ K/(m·W) were evaluated as "A". The samples of Test group 1-3 having a front end volume Vc of 14.5 to 17 $mm^3$ and a thermal resistance Ra of $1.0\times10^3$ to $4.0\times10^3$ K/(m·W) were evaluated as "B". The samples of Test group 1-3 having a front end volume Vc of 8 to 17 $mm^3$ and a thermal resistance Ra of $0.8\times10^3$ K/(m·W) were evaluated as "C". All other samples of Test group 1-3 were evaluated as "D".

As shown in TABLE 4, the samples of Test group 1-4 having a front end volume Vc of 8 to 12 $mm^3$ and a thermal resistance Ra of $1.0\times10^3$ to $6.0\times10^3$ K/(m·W) were evaluated as "A" as in the case of Test group 1-3. Also, the samples of Test group 1-4 having a front end volume Vc of 14.5 to 17 $mm^3$ and a thermal resistance Ra of $1.0\times10^3$ to $4.0\times10^3$ K/(m·W) were evaluated as "B", and the samples of Test group 1-4 having a front end volume Vc of 8 to 17 $mm^3$ and a thermal resistance Ra of $0.8\times10^3$ K/(m·W) were evaluated as "C". All other samples of Test group 1-4 were evaluated as "D".

As shown in TABLE 5, the samples of Test group 1-5 having a front end volume Vc of 8 to 12 $mm^3$ and a thermal resistance Ra of $1.0\times10^3$ to $6.0\times10^3$ K/(m·W) were evaluated as "A" as in the case of Test group 1-3. Also, the samples of Test group 1-5 having a front end volume Vc of 14.5 to 17 $mm^3$ and a thermal resistance Ra of $1.0\times10^3$ to $4.0\times10^3$ K/(m·W) were evaluated as "B", and the samples of Test group 1-5 having a front end volume Vc of 8 to 17 $mm^3$ and a thermal resistance Ra of $0.8\times10^3$ K/(m·W) were evaluated as "C". All other samples of Test group 1-5 were evaluated as "D".

In Test group 1-1, the protrusion amount H of the ceramic insulator was set to 0 mm so that the front end of the ceramic insulator was hidden in the metal shell. In this case, the following assumption can be made. As there was little part of the ceramic insulator exposed to the combustion chamber, it was difficult to raise the front end temperature of the ceramic insulator. The carbon deposits were thus incapable of being quickly burned off from the ceramic insulator and remained on the ceramic insulator. This resulted in engine start failure due to the easy occurrence of a lateral spark or a recess spark (discharge leak phenomenon).

In Test group 1-2, the protrusion amount H of the ceramic insulator was set to 1 mm so that the front end part of the ceramic insulator protruded from the front end face of the metal shell and was exposed to the combustion chamber. This made it easier to raise the front end temperature of the ceramic insulator in Test group 1-2 than in Test group 1-1. The spark plug samples having a certain level of insulation resistance or higher was thus larger in number in Test group 1-2 than in Test group 1-1. It has been shown by the above results that the insulation resistance of the spark plug can be maintained at at least 10 MΩ by controlling the front end volume Vc of the ceramic insulator to 17 $mm^3$ or smaller and controlling the thermal resistance Ra to $1.0\times10^3$ K/(m·W) or higher (as assigned "A" and "B" in TABLE 2). It has also been shown that the insulation resistance of the spark plug can preferably be maintained at least 100 MΩ by controlling the front end volume Vc of the ceramic insulator to 12 $mm^3$ or smaller and controlling the thermal resistance Ra to $1.0\times10^3$ K/(m·W) or higher (as assigned "A" in TABLE 2).

The test results of Test groups 1-3, 1-4 and 1-5 were approximately the same as those of Test group 1-2. It can be concluded from these results that the protrusion amount H of the ceramic insulator is desired to be at least 1 mm in Case 1. When the protrusion amount of the ceramic insulator is increased to an extreme, however, there may occurs excessive burning of the ceramic insulator due to the larger part of the ceramic insulator exposed to the combustion chamber. Further, the electrode tip of the center electrode becomes more likely to be consumed due to overheating as the center electrode protrudes toward the center of the combustion chamber. As seen in the after-mentioned durability test results of Experiment 2, the durability of the spark plug was higher when the protrusion amount H was 1 mm than when the protrusion amount H was 4 mm. It is thus considered that the protrusion amount H is preferably of the order of 1 mm for the proper self-cleaning function.

As shown in TABLE 6, all of the samples of Test group 2-1 was evaluated as "D" regardless of the values of the front end volume Vc of the ceramic insulator and the thermal resistance Ra.

As shown in TABLE 7, the samples of Test group 2-2 having a front end volume Vc of 8 to 12 $mm^3$ and a thermal resistance Ra of $1.0\times10^3$ to $1.5\times10^3$ K/(m·W) m·K/W were evaluated as "A". The samples of Test group 2-2 having a front end volume Vc of 14.5 to 17 $mm^3$ and a thermal resistance Ra of $1.0\times10^3$ to $1.5\times10^3$ K/(m·W) were evaluated as "B". The samples of Test group 2-2 having a front end volume Vc of 8 to 14.5 $mm^3$ and a thermal resistance Ra of $0.8\times10^3$ K/(m·W) were evaluated as "C". All other samples of Test group 2-2 were evaluated as "D".

As shown in TABLE 8, the samples of Test group 2-3 having a front end volume Vc of 8 to 12 $mm^3$ and a thermal resistance Ra of $1.0\times10^3$ to $1.5\times10^3$ K/(m·W) were evaluated as "A". The samples of Test group 2-3 having a front end volume Vc of 14.5 to 17 $mm^3$ and a thermal resistance Ra of $1.0\times10^3$ to $1.5\times10^3$ K/(m·W) were evaluated as "B". The samples of Test group 2-3 having a front end volume Vc of 8 to 17 $mm^3$ and a thermal resistance Ra of $0.8\times10^3$ K/(m·W) were evaluated as "C". All other samples of Test group 2-3 were evaluated as "D".

As shown in TABLE 9, the samples of Test group 2-4 having a front end volume Vc of 8 to 12 $mm^3$ and a thermal resistance Ra of $1.0\times10^3$ to $1.5\times10^3$ K/(m·W) were evaluated as "A" as in the case of Test group 2-3. Also, the samples of Test group 2-4 having a front end volume Vc of 14.5 to 17 $mm^3$ and a thermal resistance Ra of $1.0\times10^3$ to $1.5\times10^3$ K/(m·W) were evaluated as "B", and the samples of Test group 2-4 having a front end volume Vc of 8 to 17 $mm^3$ and a thermal resistance Ra of $0.8\times10^3$ K/(m·W) were evaluated as "C". All other samples of Test group 2-4 were evaluated as "D".

As shown in TABLE 10, the samples of Test group 2-5 having a front end volume Vc of 8 to 12 $mm^3$ and a thermal resistance Ra of $1.0\times10^3$ to $1.5\times10^3$ K/(m·W) were evaluated as "A" as in the case of Test group 2-3. Also, the samples of Test group 2-5 having a front end volume Vc of 14.5 to 17 $mm^3$ and a thermal resistance Ra of $1.0\times10^3$ to $1.5\times10^3$ K/(m·W) were evaluated as "B", and the samples of Test group 2-5 having a front end volume Vc of 8 to 17 $mm^3$ and a thermal resistance Ra of $0.8\times10^3$ K/(m·W) were evaluated as "C". All other samples of Test group 2-5 were evaluated as "D".

In Test group 2-1, the protrusion amount H of the ceramic insulator was set to 0 mm so that the front end of the ceramic insulator was hidden in the metal shell as in the case of Test group 1-1. It is assumed that the carbon deposits were incapable of being quickly burned off from the ceramic insulator and remained on the ceramic insulator, thereby resulting in engine start failure due to the easy occurrence of a lateral spark or a recess spark (discharge leak phenomenon).

In Test group 2-2, the protrusion amount H of the ceramic insulator was set to 1 mm so that the front end of the ceramic insulator protruded from the front end face of the metal shell as in the case of Test group 1-1. As the front end part of the ceramic insulator get exposed to the combustion chamber, it was easier to raise the front end temperature of the ceramic insulator in Test group 2-2 than in Test group 2-1. The spark plug samples having a certain level of insulation resistance or higher was thus larger in number in Test group 2-2 than in Test group 2-1. It has been shown that the insulation resistance of the spark plug can be maintained at at least 10 MΩ by controlling the front end volume Vc of the ceramic insulator to 17 $mm^3$ or smaller and controlling the thermal resistance Ra to $1.0\times10^3$ K/(m·W) or higher (as assigned "A" and "B" in TABLE 7). It has also been shown that the insulation resistance of the spark plug can preferably be maintained at at least 100 MΩ by controlling the front end volume Vc of the ceramic insulator to 12 $mm^3$ or smaller and controlling the thermal resistance Ra to $1.0\times10^3$ K/(m·W) or higher (as assigned "A" in TABLE 7).

The test results of Test groups 2-3, 2-4 and 2-5 were approximately the same as those of Test group 2-2. It can be concluded from these results that the protrusion amount H of the ceramic insulator is desired to be at least 1 mm in Case 2.

Although the adjustable range of the thermal resistance Ra of Case 1 was different from that of Case 2, the test results were approximately the same in the overlap between the adjustable thermal resistance ranges of Cases 1 and 2. Regardless of the adjusting method of the thermal resistance Ra, the test results were favorable as long as the thermal resistance Ra was higher than or equal to $1.0\times10^3$ K/(m·W). It is thus considered that there is almost no influence of the difference between the adjusting methods of the thermal resistance Ra on the test results.

It has been verified by the above experiment that it is possible to maintain the insulation resistance of the spark plug at 10 MΩ or higher after the smoldering/fouling test by controlling the respective parameters as follows.

$$H \geqq 1 \text{ mm}$$

$$Vc \leqq 17 \text{ mm}^3$$

$$Ra \geqq 1.0\times10^3 \text{ K/(m·W)}$$

It has also been verified that it is possible to maintain the insulation resistance of the spark plug at 100 MΩ or higher after the smoldering/fouling test by controlling the front end volume Vc of the ceramic insulator to 12 $mm^3$ or smaller.

Experiment 2

In Experiment 2, the influences of the high-temperature thermal resistance Rb on the durability of the electrode tip of the center electrode and the influences of the protrusion amount H of the ceramic insulator on the consumption of the electrode tip were tested.

Twelve kinds of samples of the ceramic insulator were prepared by combinations of six values of the thermal resistance Rb, i.e., 0.4, 0.6, 0.8, 1.0, 1.2 and 1.4 ($\times10^4$ K/(m·W)) and two values of the protrusion amount H, i.e., 1 mm and 4 mm. Twelve kinds of samples of the spark plug were produced using these samples of the ceramic insulator. The thermal resistance Rb was adjusted by changing the material of the ceramic insulator in the same manner as in Case 2 of Experiment 1. The spark plug samples were of small diameter type with a nominal diameter size of M10. Further, an iridium alloy tip was as the electrode tip in each of the spark plug samples. Each of the spark plug samples was subjected to durability test in a 2000-cc, in-line four-cylinder engine for 100 hours under the conditions of 5000 RPM and W.O.T. The durability of the spark plug was evaluated by calculation of the consumption rate (%) of the electrode tip after the durability test. The consumption rate was herein calculated as the rate of decrease in the volume of the electrode tip before and after the durability test (i.e. the value of the difference between the electrode tip volume before the durability test and the electrode tip volume after the durability test divided by the electrode tip volume before the durability test). It is noted that the electrode tip volume can be determined with e.g. an X-ray CT scanner. As the evaluation standard, the acceptance line was set to 5%, which is substantially the same as the electrode tip consumption rate of a conventional spark plug. The evaluation results are indicated in TABLE 11 and FIG. 4.

TABLE 11

| | Electrode tip consumption rate (%) after durability test | |
|---|---|---|
| Rb ($\times10^4$ K/(m · W)) | Protrusion amount: 1 mm | Protrusion amount: 4 mm |
| 0.4 | 1 | 1 |
| 0.6 | 2 | 2 |
| 0.8 | 3 | 3 |
| 1.0 | 5 | 5 |
| 1.2 | 35 | 39 |
| 1.4 | 55 | 59 |

As shown in TABLE 11, in the case where the protrusion amount H of the ceramic insulator was 1 mm, the electrode tip consumption rate was 1% when the thermal resistance Rb was $0.4\times10^4$ K/(m·W); the electrode tip consumption rate was 2% when the thermal resistance Rb was $0.6\times10^4$ K/(m·W); the electrode tip consumption rate was 3% when the thermal resistance Rb was $0.8\times10^4$ K/(m·W); the electrode tip consumption rate was 5% when the thermal resistance Rb was $1.0\times10^4$ K/(m·W); the electrode tip consumption rate was 35% when the thermal resistance Rb was $1.2\times10^4$ K/(m·W); and the electrode tip consumption rate was 55% when the thermal resistance Rb was $1.4\times10^4$ K/(m·W). In the case where the protrusion amount H of the ceramic insulator was 4 mm, by contrast, the electrode tip consumption rate was 1% when the thermal resistance Rb was $0.4\times10^4$ K/(m·W); the electrode tip consumption rate was 2% when the thermal resistance Rb was $0.6\times10^4$ K/(m·W); the electrode tip consumption rate was 3% when the thermal resistance Rb was $0.8\times10^4$ K/(m·W); the electrode tip consumption rate was 5% when the thermal resistance Rb was $1.0\times10^4$ K/(m·W); the electrode tip consumption rate was 39% when the thermal resistance Rb was $1.2\times10^4$ K/(m·W); and the electrode tip consumption rate was 59% when the thermal resistance Rb was $1.4\times10^4$ K/(m·W) as shown in TABLE 11.

Figure 4:
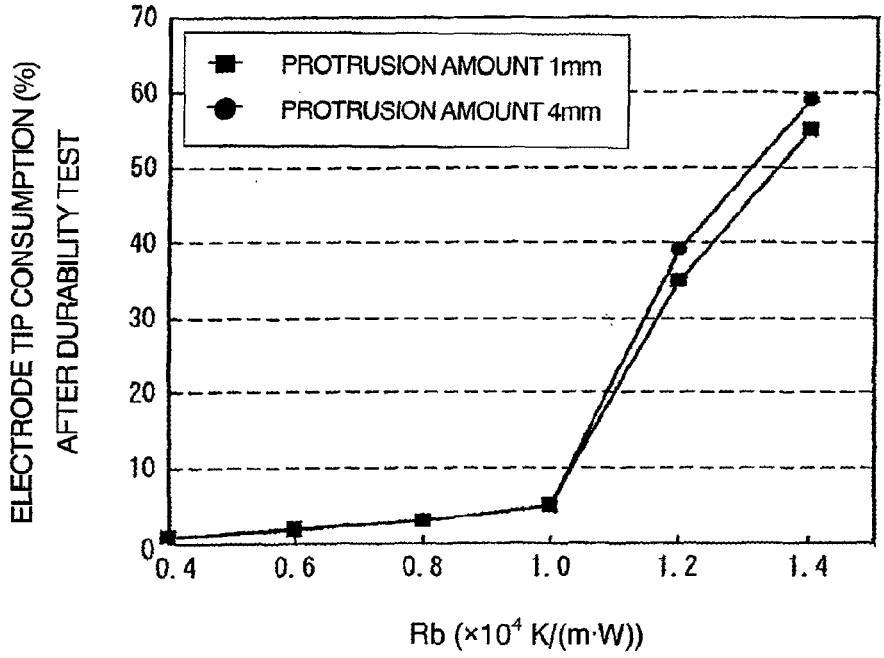
FIG. 4 is a graph showing durability test results in Examples.

As shown in FIG. 4, the electrode tip consumption rate was limited to 5% or less when the thermal resistance Rb was in the range of $0.4\times10^4$ to $1.0\times10^4$ K/(m·W) regardless whether the protrusion amount H was set to 1 mm or 4 mm. When the thermal resistance Rb exceeded $1.0\times10^4$ K/(m·W), the electrode tip consumption rate was suddenly increased due to rapid consumption of the electrode tip. It is thus concluded from these results that the electrode tip consumption can be limited to 5% or less so as to secure the sufficient durability of the spark plug by controlling the thermal resistance Rb to $1.0\times10^4$ K/(m·W) or lower. Further, the electrode tip consumption rate was made slightly higher by setting the protrusion amount H to 4 mm than by setting the protrusion amount H to 1 mm when the thermal resistance Rb exceeded $1.0\times10^4$ K/(m·W). For example, the sample with a protrusion amount H of 1 mm had an electrode tip consumption rate of 35%; and the sample with a protrusion amount H of 4 mm had an electrode tip consumption amount of 39% when the thermal resistance Rb was $1.2\times10^4$ K/(m·W). It is assumed that, as the protrusion amount H of the ceramic insulator increased, the electrode tip of the center electrode protruded into the combustion chamber and was subjected to higher temperature load.

Although the spark plug samples had a small diameter size M10 in Experiment 2, spark plug samples in which the mount thread portion had an outer diameter size M14 were subjected to durability test in the same manner as above. The electrode tip consumption rate of these samples was 3%. It can be thus concluded from Table 11 and FIG. 4 that the small-diameter spark plug of M10 size can attain a comparable level of electrode tip consumption rate to that of M14 size when the thermal resistance Rb is controlled to $0.8\times10^4$ K/(m·W) or lower.

It has been verified by the above results that it is possible to maintain the durability of the spark plug of small diameter type such as M10 type at a high level comparable to that of M14 type by controlling the thermal resistance Rb to $0.8\times10^4$ K/(m·W) or lower.

Experiment 3

In Experiment 3, the influences of the front end volume Vc of the ceramic insulator 10 on the withstand voltage characteristics were tested.

Samples of the spark plug were produced using samples of the ceramic insulator in which the front end volume Vc of the ceramic insulator was adjusted to five values: 6, 8, 12, 17 and 19 ($mm^3$). More specifically, the front end volume Vc of the ceramic insulator was adjusted to the above five values by varying combinations of the outer diameter ϕ of the center electrode ranging from 1.9 mm to 2.3 mm, the ratio of the outer diameter of the core (copper core) to the outer diameter of the center electrode ranging from 15% to 90% and the front end outer diameter ϕ of the ceramic insulator ranging from 3.1 mm to 4.3 mm. Herein, ten samples per kind of the spark plug were produced using the prepared ceramic insulator samples. Each of the spark plug samples was then subjected to durability test in a 1600-cc, in-line four-cylinder engine for 1 hour under the conditions of 5000 RPM and W.O.T. The front end part of the ceramic insulator was observed after the durability test to check the occurrence or non-occurrence of an insulation failure or failures in the ceramic insulator. The evaluation was performed on each of the sample kinds of different front end volumes Vc in two levels: "A" in the occurrence of no insulation failure in at least one of the ten samples of the same front end volume Vc; and "B" in the occurrence of an insulation failure in any one of the ten samples of the same front end volume Vc. The evaluation results are indicated in TABLE 12.

TABLE 12

| | Vc ($mm^3$) | | | | |
|---|---|---|---|---|---|
| | 6 | 8 | 12 | 17 | 19 |
| Evaluation | B | A | A | A | A |

As shown in TABLE 12, the spark plug samples of the type having a front end volume Vc of 6 $mm^3$ were evaluated as "B" as the insulation failures were detected in some of these samples. By contrast, the spark plug samples of the types having a front end volume Vc of 8 $mm^3$ or larger were evaluated as "A" with the occurrence of no insulation failure in any of the samples. It is assumed that the samples with a front end volume Vc of 6 $mm^3$ were evaluated as "B" as the front end part of the ceramic insulator was small in radial thickness (wall thickness) due to its insufficient volume so that the insulation failure occurred in the front end part of the ceramic insulator during the durability test. It has been shown that the ceramic insulator can secure a sufficient front end volume and a sufficient wall thickness so as to prevent the occurrence of insulation failure under the durability test by controlling the font end volume Vc to 8 $mm^3$ or larger.

As described above, it is possible to obtain a high effect of improving the temperature rise characteristics of the front end part of the ceramic insulator 10 so that the carbon deposits can be quickly burned off from the ceramic insulator 10 and do not remain on the ceramic insulator 10 in order to prevent the occurrence of a creeping discharge such as a lateral spark and to secure the insulation resistance of the spark plug required for proper ignition performance, by controlling the respective parameters of the spark plug.

Although the present invention has been described with reference to the above specific embodiments, the invention is not limited to these exemplary embodiments. Various modifications and variations of the embodiments described above will occur to those skilled in the art in light of the above teachings. For example, the materials of the electrode body 21 and core 25 of the center electrode 20 can alternatively be any combination of other metals i.e. metal (e.g. Fe alloy) highly resistance to spark wear and alloy (e.g. Ag alloy) higher in thermal conductivity than that of the electrode body 21 although the nickel or nickel-based alloy and the copper or copper-based alloy were used as the materials of the electrode body 21 and core 25 of the center electrode 20, respectively, in the above embodiments. Either one or both of the electrode tips 90 and 91 may not be provided.

The invention claimed is:

1. A spark plug, comprising:

a center electrode extending in an axial direction and having a front end portion;

a ceramic insulator having an axial hole formed in the axial direction to retain the center electrode in a front side of the axial hole and thereby form an assembly unit of the center electrode and the ceramic insulator;

a metal shell surrounding an outer circumference of the ceramic insulator to retain therein the assembly unit; and a ground electrode having one end portion joined to a front end face of the metal shell and one side of the other end portion facing the front end portion of the center electrode to define a spark gap therebetween, wherein the ceramic insulator has a front end portion formed with no step; and wherein the spark plug satisfies the following conditions: $H\geqq1$ mm, $Vc\leqq17$ $mm^3$ and $Ra\geqq1.0\times10^3$ K/(m·W) where H is a length by which the ceramic insulator protrudes toward the front from the front end face of the metal shell in the axial direction; Vc is a volume of part of the ceramic insulator extending within a range of 2 mm from a front end of the ceramic insulator toward the rear in the axial direction; and Ra is a thermal resistance per unit length, excluding air space, at 20° C. at a cross section of the assembly unit taken perpendicular to the axial direction at a position 2 mm away from the front end of the ceramic insulator.

2. The spark plug according to claim 1, wherein the spark plug satisfies the following condition: $Vc\leqq12$ $mm^3$.

3. The spark plug according to claim 1, wherein the spark plug satisfies the following condition: $Vc\geqq8$ $mm^3$.

4. The spark plug according to claim 1, wherein the spark plug satisfies the following condition: $Rb\leqq1.0\times10^4$ K/(m·W) where Rb is a thermal resistance per unit length, excluding air space, at 800 C.° at the cross section of the assembly unit taken perpendicular to the axial direction at the position 2 mm away from the front end of the ceramic insulator.

5. The spark plug according to claim 4, wherein the spark plug satisfies the following condition: $Rb\leqq0.8\times10^4$ K/(m·W).

6. The spark plug according to claim 1, wherein the front end portion of the ceramic insulator has a chamfered region that decreases in outer diameter toward the front; wherein the front end portion of the center electrode has a reduced diameter region that is reduced in outer diameter; and wherein a rear end of the reduced diameter region is located on a rear side of a rear end of the chamfered region.

7. The spark plug according to claim 1, wherein the metal shell has a mount thread portion formed with a thread on an outer circumferential surface thereof for screwing into a mount thread hole of an internal combustion engine; and wherein an outer diameter of the mount thread portion is smaller than or equal to a nominal diameter size M10 according to JIS specification.

8. The spark plug according to claim 1, further comprising a first noble metal tip containing Ir or Pt as a main component, having a diameter of 1 mm or smaller and joined to the front end portion of the center electrode.

9. The spark plug according to claim 1, further comprising a second noble metal tip containing Pt as a main component and at least one component of Ph, Ir, Ni and Ru and joined to the one side of other end portion of the ground electrode facing the front end portion of the center electrode so as to form the spark gap between the second noble metal tip and the front end portion of the center electrode.

10. A spark plug, comprising:

a center electrode extending in an axial direction and having a front end portion;

a ceramic insulator having an axial hole formed in the axial direction to retain the center electrode in a front side of the axial hole and thereby form an assembly unit of the center electrode and the ceramic insulator;

a metal shell surrounding an outer circumference of the ceramic insulator to retain therein the assembly unit; and a ground electrode having one end portion joined to a front end face of the metal shell and the other end portion facing the front end portion of the center electrode to define a spark gap therebetween, wherein the spark plug satisfies the following conditions: $H \geqq 1$ mm, $Vc \leqq 17$ mm$^3$, $Ra \geqq 1.0\times10^3$ K/(m·W) and $Rb \leqq 1.0\times10^4$ K/(m·W) where H is a length by which the ceramic insulator protrudes toward the front from the front end face of the metal shell in the axial direction; Vc is a volume of part of the ceramic insulator extending within a range of 2 mm from a front end of the ceramic insulator toward the rear in the axial direction; Ra is a thermal resistance per unit length, excluding air space, at 20° C. at a cross section of the assembly unit taken perpendicular to the axial direction at a position 2 mm away from the front end of the ceramic insulator; and Rb is a thermal resistance per unit length, excluding air space, at 800 C.° at the cross section of the assembly unit taken perpendicular to the axial direction at the position 2 mm away from the front end of the ceramic insulator.

11. The spark plug according to claim 10, wherein the spark plug satisfies the following condition: $Vc \leqq 12$ cm$^3$.

12. The spark plug according to claim 10, wherein the spark plug satisfies the following condition: $Vc \geqq 8$ cm$^3$.

13. The spark plug according to claim 10, wherein the spark plug satisfies the following condition: $Rb \leqq 0.8\times10^4$ K/(m·W).

14. The spark plug according to claim 10, wherein a front end portion of the ceramic insulator has a chamfered region that decreases in outer diameter toward the front; wherein the front end portion of the center electrode has a reduced diameter region that is reduced in outer diameter; and wherein a rear end of the reduced diameter region is located on a rear side of a rear end of the chamfered region.

15. The spark plug according to claim 10, wherein the metal shell has a mount thread portion formed with a thread on an outer circumferential surface thereof for screwing into a mount thread hole of an internal combustion engine; and wherein an outer diameter of the mount thread portion is smaller than or equal to a nominal diameter size M10 according to JIS specification.

16. The spark plug according to claim 10, further comprising a first noble metal tip containing Ir or Pt as a main component, having a diameter of 1 mm or smaller and joined to the front end portion of the center electrode.

17. The spark plug according to claim 10, further comprising a second noble metal tip containing Pt as a main component and at least one component of Ph, Ir, Ni and Ru and joined to the one side of other end portion of the ground electrode facing the front end portion of the center electrode so as to form the spark gap between the second noble metal tip and the front end portion of the center electrode.

* * * * *